US005330417A

United States Patent [19]

Petersen et al.

[11] Patent Number: 5,330,417

[45] Date of Patent: Jul. 19, 1994

[54] METHOD AND AN APPARATUS FOR JOINT-CONTROLLED TRAINING OF DIFFERENT MOTORIC UNITS FOR DEVELOPMENT OF FUNCTIONAL MUSCLE STRENGTH AND PROPRIOCEPTIVITY

[76] Inventors: Ken Petersen, PÅskvägen 29, Västra Frölunda; Per Renström, Persikovägen 27, Mölnlycke, both of Sweden; Malcolm Pope, 2015 Spear St., Shelburne, Vt. 05483

[21] Appl. No.: 768,272

[22] PCT Filed: May 9, 1990

[86] PCT No.: PCT/SE90/00306

§ 371 Date: Oct. 3, 1991

§ 102(e) Date: Oct. 3, 1991

[87] PCT Pub. No.: WO90/13338

PCT Pub. Date: Nov. 15, 1990

[30] Foreign Application Priority Data

May 11, 1989 [SE] Sweden ..... 8901684-4

[51] Int. Cl.[5] ..... A61F 5/00

[52] U.S. Cl. ..... 602/16; 602/26; 482/124; 601/33; 601/34

[58] Field of Search ..... 602/16, 26; 128/25 R, 128/25 B, 26; 482/124, 139, 900, 121, 122, 24

[56] References Cited

U.S. PATENT DOCUMENTS

| | | | |
|---|---|---|---|
| Re. 32,547 | 11/1987 | Reed et al. | 482/124 X |
| 3,662,602 | 5/1972 | Weiss | 482/123 X |
| 4,506,661 | 3/1985 | Foster | 602/26 |
| 4,606,542 | 8/1986 | Segal | 482/124 |
| 4,856,500 | 8/1989 | Spademan | 602/16 X |
| 4,872,665 | 10/1989 | Chariere | 128/25 R X |
| 5,002,045 | 3/1991 | Spademan | 602/26 X |
| 5,117,814 | 6/1992 | Luttrell et al. | 602/26 X |

FOREIGN PATENT DOCUMENTS 435451 10/1984 Sweden .

OTHER PUBLICATIONS

"Knee Ranger" catalogue, Jan. 1, 1992, pp. 6:13 and 6:14.

Marsden, Rothwell, and Day, "The Use of Peripheral Feedback in the Control of Movement", *TINS*, Jul. 1984, pp. 253–257.

Grillner, *Locomotion in Vertebrates: Central Mechanisms and Reflex Interaction*, pp. 248–276, 289–292, 294–304.

*Primary Examiner*—Richard J. Apley
*Assistant Examiner*—Linda C. M. Dvorak
*Attorney, Agent, or Firm*—Nixon & Vanderhye

[57] ABSTRACT

A method and apparatus for joint controlled training of different motoric units for development of functional muscle strength and proprioceptiviety, wherein the direction of action of the resistance is adjusted in relation to the muscle groups or motoric units to be trained. In the method and apparatus all joint positions are arrested for the joints associated with the groups of muscles or the motoric units to be trained. The apparatus incorporates orthoses (1, 4, 5) for arresting positions of all joints which are affected by the muscle groups or motoric units to-be-trained, as well as a non-resilient strap (8). The strap (8) facilitates adjustment of the angle under which a load (12) is applied.

15 Claims, 2 Drawing Sheets

METHOD AND AN APPARATUS FOR JOINT-CONTROLLED TRAINING OF DIFFERENT MOTORIC UNITS FOR DEVELOPMENT OF FUNCTIONAL MUSCLE STRENGTH AND PROPRIOCEPTIVITY

BACKGROUND OF THE INVENTION

Muscle strength is developed in that the muscle in question is subjected to a physical work with different forms of resistance, which may consist only of the gravity of the body part in question or of external resistance, caused e.g. by a dumbbell, barbell, expander, hydraulic or pneumatic apparatuses. As a continued development of the muscular strength is dependent of progressive increase of the work executed by the muscle, the resistance must be increased from time to time.

During the last century the dumbbell and barbell were the predominate adjustable training apparatuses for the development of maximum muscle strength. But during the last 20 years, the barbell and dumbell have been supplemented with muscle training apparatuses which permit safer and specialized muscle training.

The development of maximum muscle strength and muscle volume is achieved with exercises of short duration at high resistance of a few groups of muscles, which are trained individually. The effect of the training will be most pronounced when all relevant muscular cells or motoric units are stimulated, i.e. via training during isolation of the muscle or muscle group in question.

Such training can be executed statically (without motion) or dynamically (with motion) and isometrically (the muscle has the same length during the work) or concentrically/excentrically (the muscle shortens itself or extends itself during the work).

The art of the work results in development of different types of muscular force, whereas the size of the work resistance decides which quality of the force is to be developed: a high load means increased maximum force, a low load means endurance.

The force which can be developed by an arm or leg depends on its position and the angular orientation of the joint. Training of individual muscle groups must take into account the particular biomechanical working conditions thereof. For training the desired muscular force quality in the entire motion range of the muscle, the work resistance must be adapted to its force potential in each position during the motion.

There are but few training apparatuses fullfiling these training pre-conditions. The resistance unit is often a pneumatic or hydraulic device, which can give an isokinetic mode of work (similar speed during the motion), which is sometimes desirable. However, the big drawback with pneumatic and hydraulic training apparatuses is however that the pronounced muscle volume stimulating and energy favourable eccentric motion is not used, and that the speed of the motion can not be varied in relation to a given resistance. The speed of the motion is of big importance as to which muscle fibres are activated, as in all skeleton muscles two types of muscle fibres are present: fast-twitch and slow-twitch. The first mentioned muscle fibres are important for the force generation at rapid and heavy works whereas the later are of importance for slow and endurace characterized work.

Contrary to pneumatic or hydraulic training apparatuses the weight-based machines have the advantage of allowing eccentrical training eccentrically as well as training at different speeds with a certain resistance. The development here has resulted in a more adaptable resistance in the entire range of muscle motion, as certain training apparatuses use a so called cam disc (CAM) as a transmission. The resistance at a given weight load then is modified with the transmission thus that it is is more adapted to the muscle force generation, but this transmission is not adjustable.

The drawback of weight-based muscle training machines or at weight training is that the weights have inertia, which results in varying motion speed in different portions of the motion range. In such a case an optimum of speed and resistance is obtained only in a small range of the motion track, particularly at higher speed.

To an increasing extend, weight training today is combined with training apparatuses based on pneumatic or hydraulic devices. Weight training can be applied with free weights (e.g. barbell) for training associated muscle groups or in muscle isolating forms, such as at use of a bench equipment or apparatus equipment, i.e. a weight machine. Weight training thus gives the advantage of allowing variation of the motion speed in relation to a given resistance even if at higher speeds it will become more uncontrollable and sub-optimated, whereas with pneumatic, hydraulic or expander-based training apparatuses there is a parallel between speed and resistance. The expander-based training apparatus as compared to the pneumatic and hydraulic apparatus, provides the advantage of allowing speed variation at a given resistance, however resistance can be increased only with shortening of the muscle. The expander resistance furthermore is active in eccentric stage of motion, where the resistance decreases at extension of the muscle.

The expander unit thus provides the advantage of variable speed in relation to resistance, which via a possible adjustable transmission (possibly a CAM) can be individually adapted to the force generation of the muscle in different parts of the motion track.

The force generation in a given portion of the motion track is dependent not only of the given resistance, but the biomechanical work moment at a given joint angle gives the prerequisites for its efficiency and decides together with motion speed, the size and direction of the resistance, which of the different muscle fibres or of the motoric units the muscle are engaged.

Not only the selection of engaged motoric units is decided by these factors, but they also influence the proprioceptive nerve functions, ligaments, cartilage and the skeleton structure in different manners.

These conditions are known, but the significance of the direction of the resistance has not been noticed at development of training apparatuses. However, there has issued a patent for a muscle training apparatus, which can be modified to all possible exercises for most skeleton muscles.

This training apparatus, which simultaneously is a computerized measuring apparatus for exercise parameters (motion speed, given resistance and direction of the resistance in all segments of the motion track, etcetera) has a resistance level and direction which can be modified, and a resistance unit, which can be modified (imitating the advantage of the weight unit with inertia and variable speed to the resistance size and eccentric training function).

This training apparatus thus has the ability of stimulating specific motoric units and is therefore useful for training functional muscular force and nerve function.

Beside the fact that this apparatus is big, complex and very expensive it is on the other hand not selectively functional in its training of muscular force, proprioceptive nerve function, ligament function, cartilage function and skeleton function, as it has no possibility of controlling the joint angle/angles of the training person, which angles are engaged in different parts of the motion track, and the selection i.a. of motoric units, therefore vary more from one motion repetition to another than at the joint controlling training apparatus according to the invention described hereinafter.

The importance of the possibility of controlling every factor in the training motion is crucial for development of the very quality aimed at in the shortest and most effective time (muscular strength, coordination, speed, muscular endurance, nerve function). This is of great importance in athletics, but it is at least as important in patient rehabilitation, wherein the physical development today is carried out in integrated as well as differentiated forms (training of every component separately, i.e. muscular strength separately, speed separately, etcetera). Each separate component in differentiated training has specific training requirements for obtaining most efficient development. The development of maximum muscular strength as mentioned requires a high resistance with a few repetitions in the desired neuromuscular path desired in each joint position. The position of the joint thereby must be arrested for involved joints in order to make the selection of stimulated motoric units as exact as possible, at otherwise unaltered conditions. All differentiated muscular training therefore must be exercised in such a joint controlled manner as possible. As muscles often have a function and therefore extend over one or more joints, and as the force development of the muscle also depends on the initial length of the muscle prior to its contraction it is necessary that the joint angles are controlled during the training motion.

No known training apparatus has the ability of controlling both the joint angle/angles and the direction of the resistance. The training apparatus now sketched is unique in that the selection of stimulated motoric units is better than at any other known apparatus.

PURPOSE AND MOST ESSENTIAL FEATURES OF THE INVENTION

The purpose of the present invention is to provide a method, enabling a selective functional and joint controlled training of different motoric units for development of functional muscular strength and proprioceptivity. This has been achieved in that the direction of action of the resistance has been adjusted in relation to the muscular groups or motoric units, which shall be trained and that all joint positions are arrested for the joints, associated with the groups of muscles or the motoric units respectively to be trained.

The invention also incorporates a training apparatus for performing the method according to the invention, and this apparatus is characterized therein that the apparatus incorporates means for arresting the position of all joints affected by muscle groups or motoric units resp. to be trained, and means by which the angle under which a load is applied is arbitrarily adjustable.

DESCRIPTION OF DRAWINGS

Hereinafter the invention will be further described with reference to a non-limiting embodiment of a training apparatus intended for knee-joint training and shown in the accompanying drawings.

DESCRIPTION OF EMBODIMENT

Figure 1:
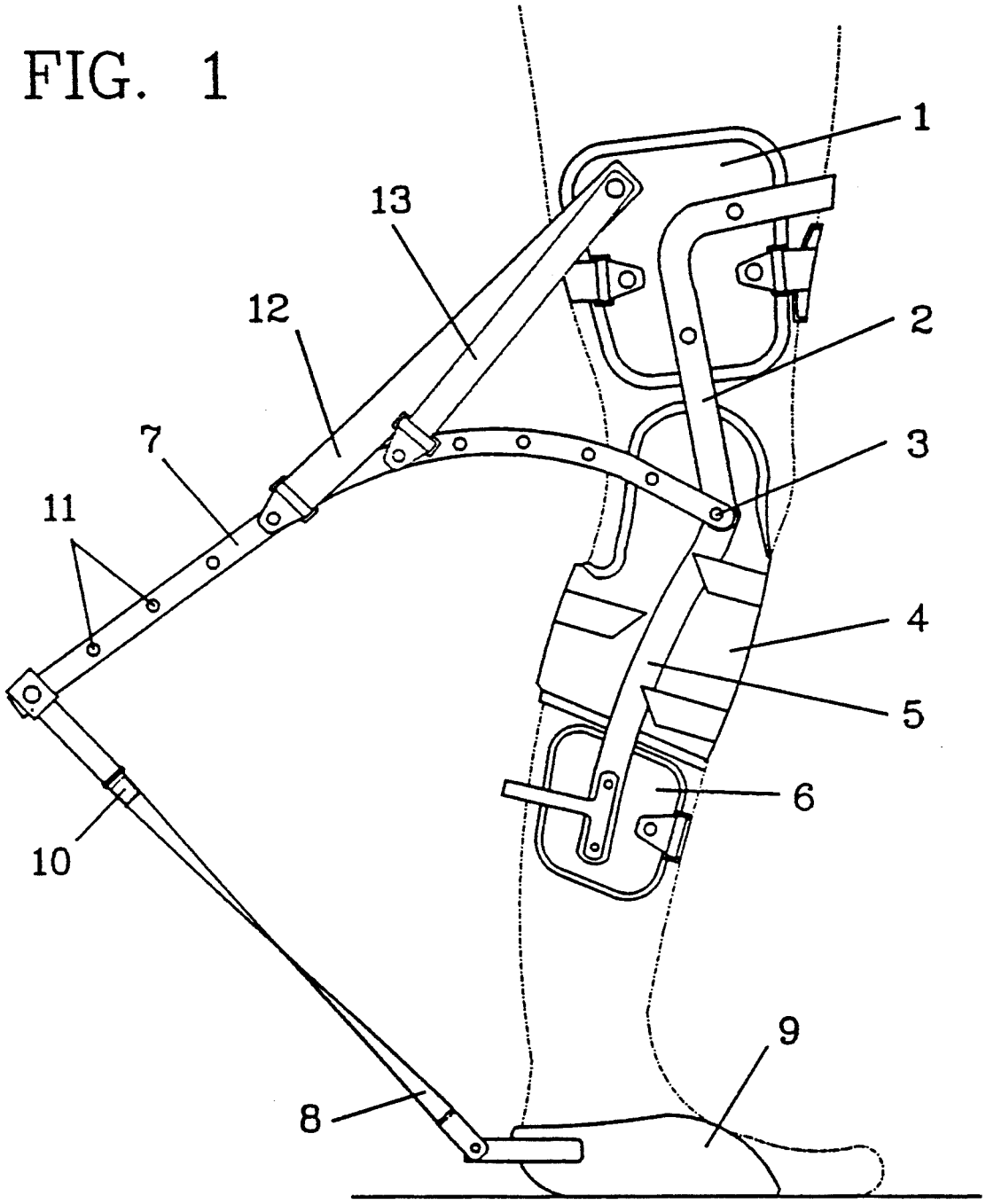
FIG. 1 shows an apparatus according to the invention in side view.
Figure 2:
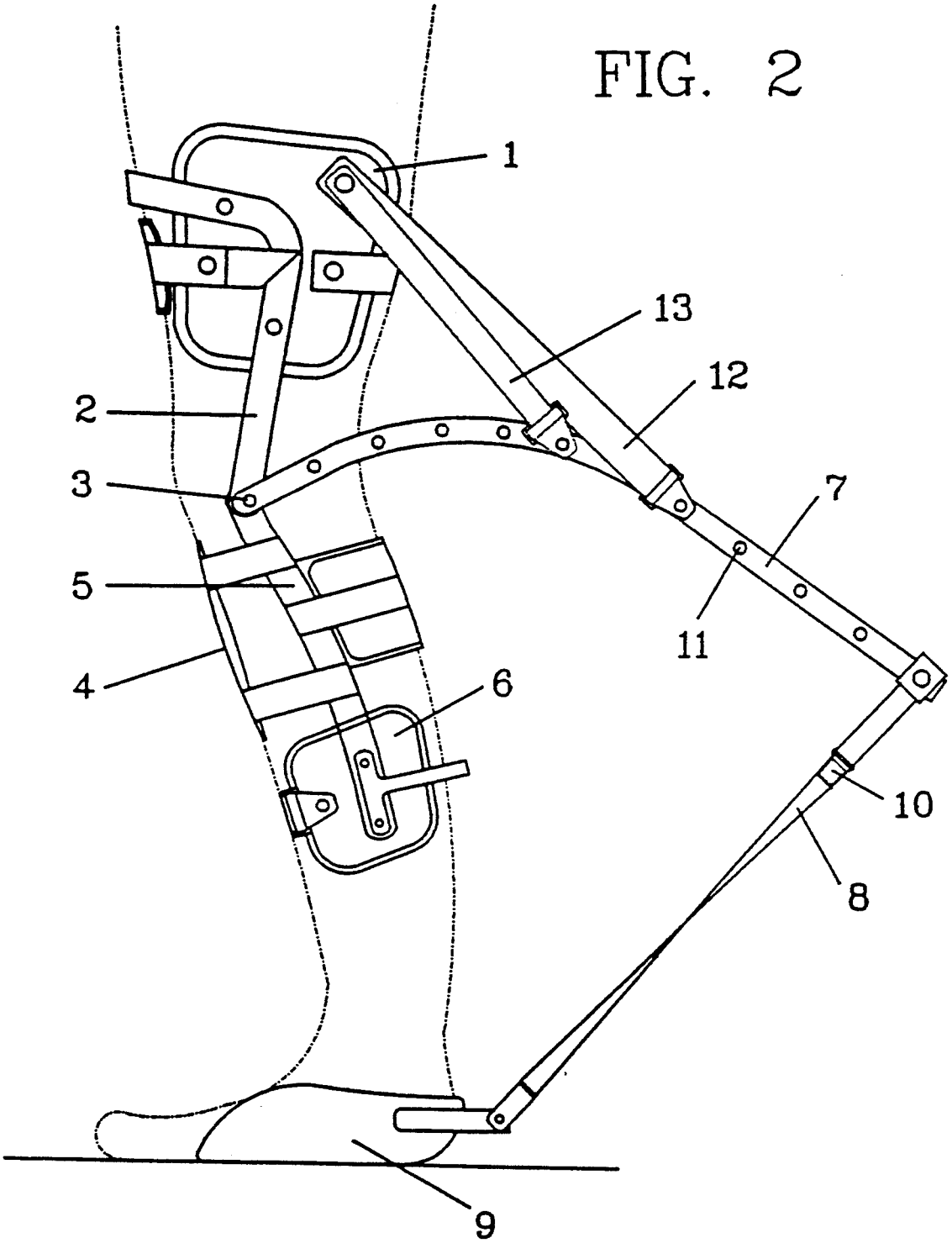
FIG. 2 is a corresponding view shown from the opposite side.

FIGS. 1 and 2 show in two side views from opposite sides an embodiment of a muscle training apparatus according to the invention, which is designed for knee-joint training. The figures show a leg intimated in dash-and-dot lines, and upon which the apparatus has been applied.

The apparatus shown incorporates a thigh orthosis 1 provided with a rail 2 fixedly fitted thereto and extending downwards to a joint position 3 provided upon a knee orthosis 4. The joint positions 3 are applied in such a manner to the knee orthosis, that they constitute a joint axis extending through the knee-joint of the training person, when the apparatus is used. In each joint position 3 is furthermore articulatedly fitted a depending rail 5, which is fixedly attached to a lower leg orthosis 6. An articulatedly supported, rigid and arc-shaped arm 7, projects from each joint position 3, and which arms extend in a direction rearwardly out from the main extension of the articulated rails when the leg is stretched.

At the outer end of the arc-shaped arms 7 there is articulatedly fitted a first end of a non-resilient strap 8. A second end of strap 8 is articulatedly affixed to a foot brace 9, which when used is fitted to the foot of the training person. This non-resilient strap 8 is equipped with a strap lock 10, by aid of which the distance between the end of the arc-shaped arm 7 facing away from the joint position 3 and the foot brace 9 may be adjusted.

The arc-shaped arms 7 are provided with a number of equidistantly spaced apart attachment holes 11 provided along the extension of the arms. The holes accommodate one end of a load, which in the example is an expandable strap or expander 12, and which with its opposite ends are fitted articulatedly to the thigh orthosis 1. The expandable load may also be substituted for a static load in form of non-resilient straps 13, such as intimated with dash-lines in the figures.

As the expanders 12 can be attached to different attachment holes 11 along the extension of the arms 7 it is possible to vary the size of the load due to the possibility of adjusting the distance between the foot brace 9 and the ends of the arms turned away from the knee orthosis by means of the belt lock 10, it is also possible to adjust the direction of the load as desired and as needed in dependency of the muscle groups or motoric units to be trained.

The apparatus shown in the figures in only one example of a training apparatus for knee-joint training, but the apparatus can of course be modified for this and other training purposes within very wide ranges without departing from the scope of the accompanying claims.

The apparatus is generally based on anatomically adapted orthoses, i.e. primarily knee protectors and stabilizers, which are provided with a resistance load, in the embodiment shown a double set of expanders, which via a variable transmission is affixed at one side each of the knee-joint and extend from the thigh orthosis 1 beyond the orthosis 6 of the lower leg to the centre axis of the foot, from where the direction of the resistance is decided via the angle: from the lower leg to the pair of arc-shaped arms or the transmission brace. A non-resilient transmission brace for arresting the centre axis of the knee-joint, but which does not intrude on the motion path, here ascertains a constant resistance direction over the entire motion range and the set of expanders give a possibility of eccentric training load and resumption to the initial position in a 90° knee bend.

Due to the fact that the set of expanders is variably attachable in longitudinal direction, different load choices are allowed and a high recruitment of motoric units 12 is made possible during the entire knee extension as the expander resistance increases concurrently with the increase of the knee extension force.

As the expander set is exchangeable for a non-resilient resistance, in the form of a strap 13, but which may also be hydraulic or pneumatic, it is possible to adjust the apparatus for isometric training in several joint angles. The knee apparatus may also use a weight magazine resistance with or without a CAM transmission if used on a so-called quadriceps bench and being affixed to this structure.

The present design intends that the hip joint and ankle joint be kept at a constant angle during the entire knee motion, regardless of the chosen load angle. For this reason the above-described knee training apparatus has no affixations to the hip joint and the ankle joint. The present design is thus simpler than devices which require coordinated controlled angular motion of the hip joint and ankle joint (additionally involving hip joint and ankle joint orthoses) along with control of the primarily trained knee-joint motion.

The knee training apparatus described hereinbefore is built from a light material, it has high strength and is thereby easily transportable, which makes the apparatus of interest for training at home and during travel.

The training apparatus is not only suited for training of selected motoric units but also for bodybuilding, where the tangential direction of resistance corresponds to muscle isolating training, so-called peaking, whereas the more longitudinal direction causes heavy volume training.

The described training apparatus for development primarily of maximum functional muscular strength (but also for preserving the strength of other structures in the ligaments and the joint cartilage of the extremity), is designed primarily for training the organ structures of the knee-joint, but the principle of the apparatus can also apply to other extremity joints in the human body and including both hinge joints and ball joints (hip joints, shoulder joints).

The training apparatus may also be designed as a part of a complete, body-covering "training suit", which via multiple joint control can train most of the big muscles in a manner selected for the motoric units, but it can also be designed as a memorizing suit for the motoric units via addition of electronic apparatuses with feedback and feedforward signals. (In principle an astronaut suit for adjustable training of different functions of the human motion system).

We claim:

1. An apparatus for joint controlled training of motoric units for development of functional muscle strength and proprioceptivity, the apparatus comprising:

means for arresting a joint axis associated with a muscle group or motor unit to be trained;

brace means provided below the joint axis;

at least one arm pivotally connected to the arresting means at the joint axis;

load application means connected between the arm and the arresting means for applying a load to the muscle group or motor unit to be trained;

angle adjusting means connected between the arm and the brace means for adjusting an angle under which the load is applied to the muscle group or motor unit to be trained.

2. An apparatus as claimed in claim 1, wherein the means for arresting comprises:

a first orthosis member extending above the joint axis associated with a muscle group or motor unit to be trained;

a second orthosis member extending below the joint axis;

orthosis connecting means for connecting the first orthosis member and the second orthosis member;

and wherein the arm is pivotally connected to the orthosis connecting means at the joint axis.

3. An apparatus as claimed in claim 2, wherein the first orthosis member, the second orthosis member, and the brace means are all adapted to be attached to a limb; and wherein the arm, the load application means, and the angle adjusting means are situated substantially entirely to one side of the limb.

4. An apparatus as claimed in claim 1, wherein the arm has a substantially arcuate shape, the arm having a curved projection on a plane perpendicular to the joint axis.

5. An apparatus as claimed in claim 4, wherein the arm has means at a plurality of positions thereon for selective attachment of the load application means to one of the positions thereof.

6. An apparatus as claimed in claim 5, wherein the arm has a plurality of equi-distantly spaced-apart attachment holes thereon for attachment of the load application means to one of the holes thereof.

7. An apparatus as claimed in claim 1, wherein the load application means comprises a strap connected between the arm and the arresting means.

8. An apparatus as claimed in claim 7, wherein the strap is an elastic strap.

9. An apparatus as claimed in claim 7, wherein the strap is an inelastic strap.

10. An apparatus as claimed in claim 1, wherein the limb is a leg and the joint axis is a knee joint axis, and wherein brace means is adapted to be secured to a foot.

11. An apparatus as claimed in claim 1, wherein the angle adjusting means comprises a strap connected to the arm and means for controlling the length of the strap.

12. An apparatus as claimed in claim 1, wherein the forces exerted by the load application means and the angle adjusting means produces a resultant force vector having a projection on a plane perpendicular to the joint axis.

13. An apparatus as claimed in claim 12, wherein the projection of the resultant force vector is inclined with respect to the horizontal.

14. An apparatus for knee-joint controlled training of motoric units for development of functional muscle strength and proprioceptivity, the apparatus comprising:

means for arresting a knee joint axis, the arresting means comprising:

a first orthosis member extending above the knee joint axis;

a second orthosis member extending below the knee joint axis;

orthosis connecting means for connecting the first orthosis member and the second orthosis member;

brace means secured to a foot;

at least one arm pivotally connected to the arresting means at the joint axis, the arm being arcuately shaped and having a curved projection on a plane perpendicular to the joint axis;

load application means connected between the arm and the arresting means for applying a load to the muscle group or motor unit to be trained, the load application means comprising a first strap;

angle adjusting means connected between the arm and the brace means for adjusting an angle under which the load is applied to the muscle group or motor unit to be trained, the angle adjusting means comprising a second strap connected to the arm and means for controlling the length of the strap.

15. An apparatus for exercising a limb, the apparatus comprising:

means for arresting a joint axis located on the limb;

brace means provided below the joint axis;

at least one arm pivotally connected to the arresting means at the joint axis;

load application means connected between the arm and the arresting means for applying a load to the limb;

angle adjusting means connected between the arm and the brace means for adjusting an angle under which the load is applied to the limb.

* * * * *